US011747058B2

(12) United States Patent
Porwal et al.

(10) Patent No.: US 11,747,058 B2
(45) Date of Patent: Sep. 5, 2023

(54) AIR RECIRCULATION SYSTEMS FOR HEAT PUMPS

(71) Applicant: Rheem Manufacturing Company, Atlanta, GA (US)

(72) Inventors: Piyush Porwal, Montgomery, AL (US); Alex Williams, Montgomery, AL (US); Tobey Fowler, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 182 days.

(21) Appl. No.: 17/094,158

(22) Filed: Nov. 10, 2020

(65) Prior Publication Data

US 2022/0146157 A1 May 12, 2022

(51) Int. Cl.

| | |
|---|---|
| ***F25B 30/02*** | (2006.01) |
| ***F24F 5/00*** | (2006.01) |
| ***F24H 4/04*** | (2006.01) |

(52) U.S. Cl.

CPC ..... *F25B 30/02* (2013.01); *F24F 5/0096* (2013.01); *F24H 4/04* (2013.01); *F24F 2221/183* (2013.01); *F25B 2313/029* (2013.01); *F25B 2313/0314* (2013.01); *F25B 2339/047* (2013.01); *F25B 2500/08* (2013.01)

(58) Field of Classification Search

CPC ..... F25D 23/003; F24D 15/04; F24D 17/02; F24H 4/02; F24H 4/04

See application file for complete search history.

(56) References Cited

U.S. PATENT DOCUMENTS

| | | | | |
|---|---|---|---|---|
| 2,795,938 A * | 6/1957 | Galazzi | F24H 4/04 | 62/186 |
| 4,459,816 A * | 7/1984 | Lung | F25B 30/02 | 62/262 |
| 4,523,438 A * | 6/1985 | Curti | F24D 17/02 | 237/2 B |
| 5,220,807 A * | 6/1993 | Bourne | F24H 4/04 | 392/464 |
| 5,678,417 A * | 10/1997 | Nigo | F24F 1/0057 | 236/44 R |

(Continued)

FOREIGN PATENT DOCUMENTS

| | | |
|---|---|---|
| FR | 3023358 A1 | 1/2016 |
| WO | 2019089559 A1 | 5/2019 |

OTHER PUBLICATIONS

International Search Report and Written Opinion for PCT Application No. PCT/US2021/058566 dated Feb. 17, 2022.

*Primary Examiner* — Christopher R Zerphey
(74) *Attorney, Agent, or Firm* — Eversheds Sutherland (US) LLP

(57) ABSTRACT

Air recirculation systems for heat pumps are disclosed. The air recirculation systems include a heat pump subsystem and a recirculation subsystem. The recirculation subsystem can include one or more arms that direct cool, dehumidified air flowing from the heat pump subsystems back to air inlets. The recirculation subsystems can transition from open to closed configurations either manually or via motors. The air recirculation systems can include a controller that outputs a control signal to the motors to open or close the recirculation subsystems. The control signals can be based on temperature data, current data, and the like.

20 Claims, 9 Drawing Sheets

(56) References Cited

U.S. PATENT DOCUMENTS

| | | | | |
|---|---|---|---|---|
| 6,796,223 | B2 * | 9/2004 | Jiang | F26B 21/06 219/400 |
| 9,206,995 | B2 * | 12/2015 | Nelson | F24H 4/04 |
| 9,739,392 | B2 * | 8/2017 | Shaffer | F16K 31/602 |
| 2004/0108388 | A1 * | 6/2004 | Wacker | G05D 22/02 236/44 C |
| 2014/0260392 | A1 | 9/2014 | Hawkins et al. | |

* cited by examiner

AIR RECIRCULATION SYSTEMS FOR HEAT PUMPS

FIELD OF THE DISCLOSURE

Examples of the present disclosure relate generally to heat pump systems and, more specifically, to air recirculation systems for a heat pumps that recirculate cool air to air inlets.

BACKGROUND

Heat pump systems, including those used in water heater systems, require air flow to provide the necessary heat required of the system. As air flows past evaporators in the heat pump system, the refrigerant within the evaporators absorbs the heat from the air. Although the heat from the air is beneficial for heating refrigerant in evaporators, excessive heat is not as beneficial for other components of the heat pump system. For example, heat pumps also include a compressor, a fan, and other electrical components that draw a current. Of course, when dealing with electrical components, excessive heat can cause drops in efficiencies.

This problem is only exacerbated in the case of heat pump systems for water heaters. These types of appliances are typically placed in alcoves, closets, or attics that have very little ventilation or are regularly hot. The temperature in an attic, for example, can regularly exceed 100° F. In these environments, it is difficult for the compressor, fan, and the like to dissipate heat, which can cause the components to work harder and, in turn, draw more current. This can be problematic for circuit breakers that trip at lower amperages (e.g., 15A).

A solution to this problem is to move the heat pump water heater to a location that is air conditioned and/or well ventilated. This is not always possible or desirable, however. What is needed, therefore, are systems and methods that can provide a cooler working condition for a heat pump system while also enabling the heat pump system (e.g., heat pump water heater) to be stored in traditional, out-of-the-way spaces.

BRIEF SUMMARY

These and other problems can be addressed by the technologies described herein. Examples of the present disclosure relate generally to heat pump systems and, more specifically, to air recirculation systems for a heat pump water heaters that recirculate cool air to air inlets.

The present disclosure provides an air recirculation system. The system can include a heat pump subsystem. The heat pump subsystem can include a fan, a fan outlet, and a first air inlet. The system can include a recirculation subsystem. The recirculation subsystem can include a duct adapter positionable proximate the fan outlet. The recirculation subsystem can include a first arm extending from the duct adapter. The first arm can include (i) a first arm inlet positioned proximate the duct adapter and (ii) a first arm outlet. The first arm can direct air from the duct adapter to the first air inlet.

The heat pump subsystem can include a vent grate positioned proximate the fan. The duct adapter can be detachably attachable to the vent grate. The duct adapter can include a plurality of attachment members that can engage with the vent grate.

The recirculation subsystem can include a first damper that can transition between an open configuration and a closed configuration. When in the open configuration, air can pass through the first arm outlet; when in the closed configuration, air is directed entirely through a duct outlet. The system can include a motor to move the first damper between the open configuration and the closed configuration. The system can include a controller to output a control signal to the motor to move the first damper between the open configuration and the closed configuration.

The system can include a temperature sensor positioned external to the heat pump subsystem and in communication with the controller. The controller can output the control signal to the motor to move the first damper to the open configuration when an ambient temperature proximate the system is above a predetermined value.

The system can include a temperature sensor positioned proximate the duct adapter and in communication with the controller. The controller can output the control signal to the motor to move the first damper to the open configuration when an air temperature of air from the fan is above a predetermined value.

The system can include a current sensor to detect current into the heat pump subsystem. The controller can output the control signal to the motor to move the first damper to the open configuration when current into the heat pump subsystem is above a predetermined value.

The recirculation subsystem can be rotatable upon the heat pump subsystem such that the first arm outlet can be moved from a first position distal to the first air inlet to a second position proximate the first air inlet. The system can include a rotational motor that can rotate the recirculation subsystem with respect to the heat pump subsystem. The system can include a controller that can output a control signal to the rotational motor to move the first arm outlet from the first position to the second position. The system can include a temperature sensor positioned external to the heat pump subsystem and in communication with the controller. The controller can output the control signal to the rotational motor to move the first arm outlet from the first position to the second position when an ambient temperature proximate the system is above a predetermined value.

The heat pump subsystem can include a second air inlet. The recirculation subsystem can include a second arm extending from the duct adapter and comprising a second arm inlet positioned proximate the duct adapter and a second arm outlet. The second arm can direct air from the duct adapter to the second air inlet.

The present disclosure provides an air recirculation apparatus. The apparatus can be referred to throughout this disclosure as a recirculation subsystem. The apparatus can include a duct adapter positionable upon a heat pump subsystem. The apparatus can include a first arm extending from the duct adapter. The first arm can include (i) a first arm inlet positioned proximate the duct adapter and (ii) a first arm outlet. The first arm can direct air from the duct adapter to a first air inlet of the heat pump subsystem. The apparatus can include a second arm extending from the duct adapter. The second arm can include (i) a second arm inlet positioned proximate the duct adapter and (ii) a second arm outlet. The second arm can direct air from the duct adapter to a second air inlet of the heat pump subsystem.

The duct adapter can include a plurality of inwardly facing attachment members sized to engage with a vent grate of the heat pump subsystem. The apparatus can include a first damper disposed along the first arm. The first damper can transition between an open configuration and a closed configuration. The apparatus can include a second damper disposed along the second arm. The second damper can transition between an open configuration and a closed configuration. When the first damper and the second damper are in the open configurations, air can pass through the first arm outlet and the second arm outlet. When the first damper and the second damper are in the closed configurations, air can be directed entirely through a duct outlet of the duct adapter.

The apparatus can include a first motor to move the first damper between the open configuration and the closed configuration. The apparatus can include a second motor to move the second damper between the open configuration and the closed configuration. The apparatus can include a controller to output a first control signal to the first motor to move the first damper between the open configuration and the closed configuration. The controller can output a second control signal to the second motor to move the second damper between the open configuration and the closed configuration.

The apparatus can include a temperature sensor positioned proximate the duct adapter and in communication with the controller. The controller can output the first control signal to the first motor and the second control signal to the second motor to move the respective motors to the open configuration when air flowing through the duct adapter is above a predetermined value.

The apparatus can include a temperature sensor in communication with the controller. The controller can output the first control signal to the first motor and the second control signal to the second motor to move the respective motors to the open configuration when an ambient temperature proximate the apparatus is above a predetermined value.

The apparatus can include a current sensor to detect current into the heat pump subsystem. The controller can output the first control signal to the first motor and the second control signal to the second motor to move the respective motors to the open configuration when current into the heat pump subsystem is above a predetermined value.

The controller can include an input/output interface that can receive a wired or wireless communication from a weather service provider comprising data indicative of outside temperature. The controller can output the first control signal to the first motor and the second control signal to the second motor to move the respective motors to the open configuration when the data indicates the outside temperature is above a predetermined value.

The present disclosure also further describes the controller in detail and provides methods of controlling the systems described herein using the controller. These and other aspects of the present disclosure are described in the Detailed Description below and the accompanying figures. Other aspects and features of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various other examples of the disclosure discussed herein. In similar fashion, while examples may be discussed below as devices, systems, or methods, it is to be understood that such examples can be implemented in various devices, systems, and methods of the present disclosure.

BRIEF DESCRIPTION OF THE DRAWINGS

The accompanying drawings, which are incorporated in and constitute a part of this specification, illustrate multiple examples of the presently disclosed subject matter and serve to explain the principles of the presently disclosed subject matter. The drawings are not intended to limit the scope of the presently disclosed subject matter in any manner. In the drawings.

DETAILED DESCRIPTION

Figure 1:
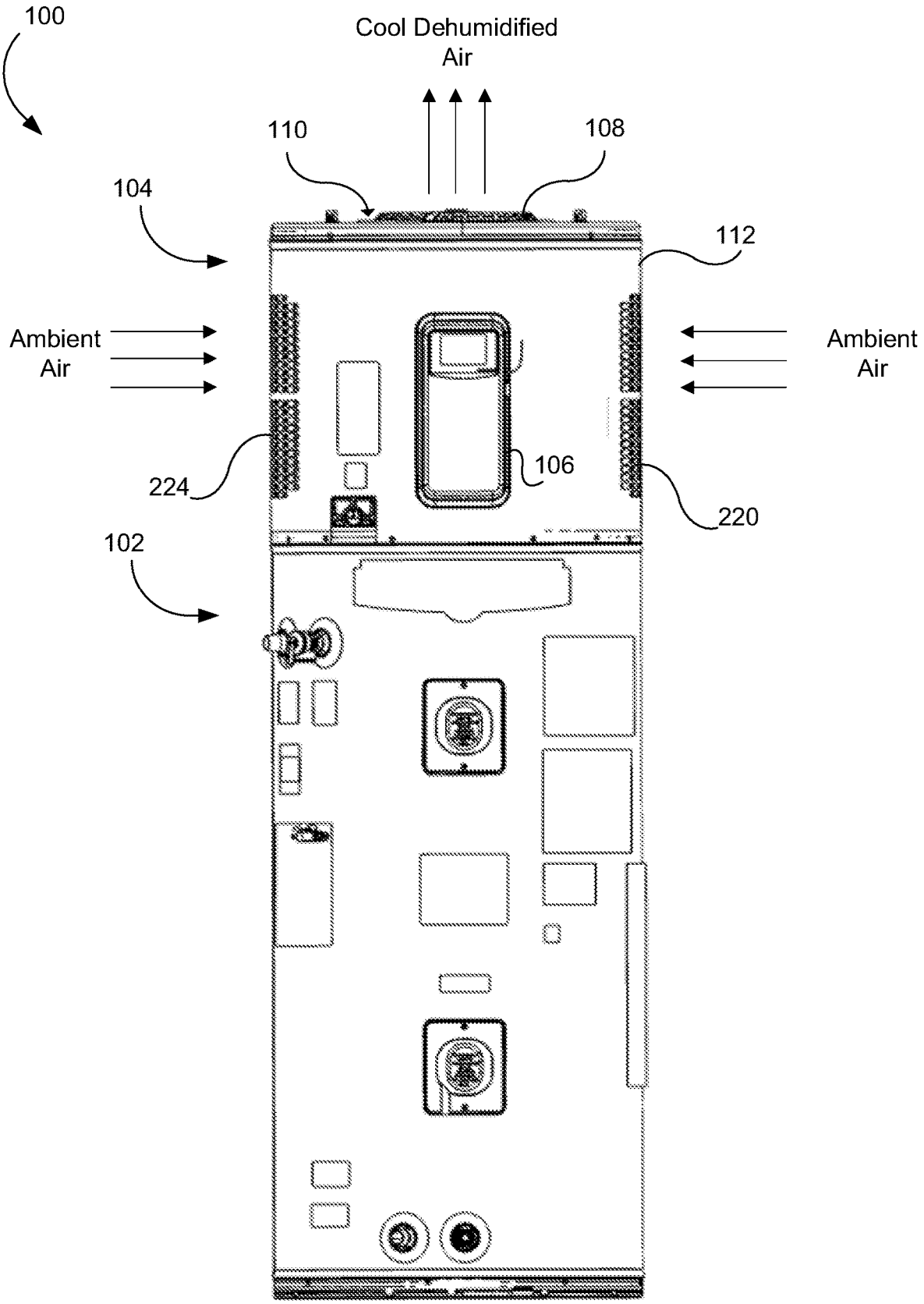
FIG. 1 is a side view of a heat pump water heater, which includes a water heater and a heat pump subsystem.

Appliance manufacturers aim to develop appliance designs that are both energy efficient and effective. For heating appliances, such as water heaters, this has led to the development of new designs that are both energy efficient and highly effective with respect to heating capability, and these designs include the heat-pump water heater. The heat pump water heater (or a hybrid water heater that includes a heat pump) relies on refrigerant, evaporators, compressors, and fans to draw heat from ambient air and transfer the heat to potable water stored in tanks.

The efficiency of heat-pump water heater systems can be downgraded, however, on account of the conditions in which these types of appliances are stored within buildings. A water heater, for example, is ordinarily stored in alcoves, closets, or attics so that they are out of view and out of mind. The issue with this convention is that these locations typically lack ventilation or air conditioning. That said, when a heat pump system—which includes a compressor, fan, and other electronic components—runs in these locations, it is likely that the ambient temperature around the system can exceed ideal operating temperatures. The temperature in an attic can regularly exceed 100° F., for example. These high temperature settings may degrade the efficiency of electrical components like the compressor and fan, because there is no way in existing systems to radiate the heat that comes from operating these components. This can cause an increase in current required to run the internal components.

The present disclosure provides a solution to the overheating of heat pump systems stored in hot and/or unventilated areas. The systems described herein include an air recirculation system that includes both the heat pump subsystems and a recirculation subsystem or apparatus. The recirculation subsystem can be positionable near the heat pump subsystem such that it can recirculate air output by the fan of the heat pump subsystem. Air that exits a heat pump is cool and dehumidified as a result of passing across an evaporator. After the evaporator removes the heat from the flowing air, the fan expels this cool air external to the heat pump. Ordinarily, this cool air is unutilized because it is expelled into the surrounding space and radiates away from the heat pump. The present disclosure takes advantage of the cool outlet air and by recirculating the air into one or more air inlets of the heat pump subsystem. The recirculation subsystem can be a permanent fixture or can be detachably attachable to the heat pump subsystem. Further, the recirculation subsystem can include features that enable the system to recirculate cool air when needed, but enable the system to expel cool air as normal when recirculation is not in demand. For example, in the winter, the closet, alcove, attic, etc. in which the heat pump subsystem is stored may be below the temperatures that can increase the current draw of the electronic components. Accordingly, the recirculation subsystems described herein can be removable when not needed. Alternatively or in addition, recirculation subsystems can include dampers that can open and close according to the environmental conditions of the heat pump subsystem.

Various systems and methods are disclosed for air recirculation systems for heat pumps, and example systems will now be described with reference to the accompanying figures. FIG. 1 is a side view of a heat pump water heater 100, which includes a water heater 102 and a heat pump subsystem 104. The example heat pump water heater 100 does not show a recirculation subsystem (e.g., recirculation subsystem 200) as described herein. However, the heat pump water heater 100 in FIG. 1 provides a view of air flow in a heat pump water heater 100. The heat pump subsystem 104 can draw in ambient air at a first air inlet 220. In some systems, the first air inlet 220 can be positioned near a first evaporator 218 such that air flows across the first evaporator 218. The example heat pump water heater 100 in FIG. 1 (and throughout this disclosure) includes a second air inlet 224, which can be positioned near a second evaporator 222. It is not necessary that the heat pump water heaters 100 described herein are dual-inlet, dual evaporator systems. The recirculation subsystem 200 described herein can be used equally with systems having only a first air inlet 220.

Once air is drawn (e.g., via fan 216) into the first air inlet 220 and/or second air inlet 224, the air can pass the evaporators 218, 222, be cooled by the evaporators 218, 222, and exit the heat pump subsystem 104 at a fan outlet 110. The fan outlet 110 can be covered, for example, by a vent grate 108, which will be described in greater detail below. As shown in FIG. 1, once the ambient air enters the heat pump subsystem 104, it exits as cool, dehumidified air. This cool air, however, escapes the heat pump subsystem 104 and is not recirculated, meaning additional warm ambient air continues to be circulated through the heat pump subsystem 104.

Figure 2:
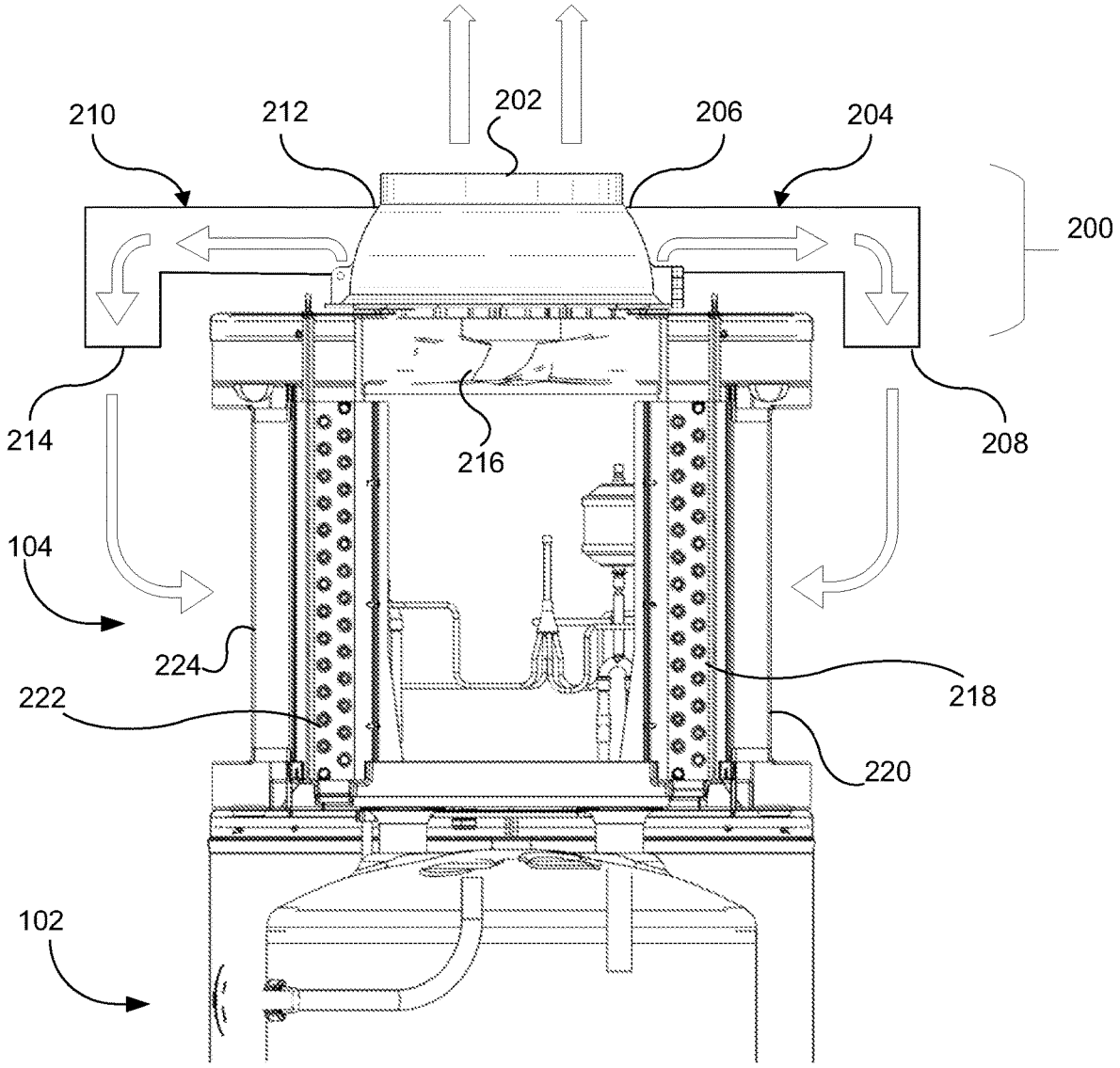
FIG. 2 is a cross-sectional view of a heat pump water heater having a heat pump subsystem and a recirculation subsystem, according to the present disclosure.

FIG. 2 is a cross-sectional view of a heat pump water heater 100 having a heat pump subsystem 104 and a recirculation subsystem 200, according to the present disclosure. The cutaway view of the heat pump subsystem 104 shows how the first evaporator 218 can be positioned proximate the first air inlet 220, and, when present, the second evaporator 222 can be positioned proximate the second air inlet 224. The recirculation subsystem 200 can include a duct adapter 202 that is positionable near the fan outlet 110 of the heat pump subsystem 104. The recirculation subsystem 200 can include a first arm 204 extending from the duct adapter 202. The first arm 204 can be sized to extend from a first end proximate the duct adapter 202 to a second end proximate the first air inlet 220.

The first arm 204 can include a first arm inlet 206 positioned proximate the duct adapter 202 and a first arm outlet 208 positionable near the first air inlet 220. The shape and configuration of the first arm 204 can be adjusted based on the location of the fan outlet 110 (e.g., near the duct adapter 202) and the first air inlet 220. For example, the fan outlet 110 can be at the top of the heat pump subsystem 104 shown in FIG. 2, and the first air inlet 220 can be positioned at a side of the heat pump subsystem 104. The first arm 204, therefore, can include a bend and/or curve to accommodate these positions such that that a first arm outlet 208 can be positioned near the first air inlet, as shown in FIG. 2.

As described above, some heat pump subsystems 104 can include a second air inlet 224, which can be positioned near a second evaporator 222. It is contemplated, therefore, that the recirculation subsystem 200 can include a second arm 210 to direct cool air to the second air inlet 224. The second arm 210 can include a second arm inlet 212 and a second arm outlet 214. The second arm 210 can be substantially similar to the first arm 204 described above.

A fan 216 can be positioned within the heat pump subsystem 104 to draw air into the first air inlet 220 and/or second air inlet 224. In some examples, the fan 216 can be positioned between the two air inlets 220, 224, as shown in FIG. 2. However, nothing requires the configuration shown in the figure, and the fan 216 can be positioned at other locations to draw air into the inlet(s). Unless otherwise stated in this disclosure, when reference is made herein to a single arm (e.g., a first arm 204), it will be understood that the specific example can also refer to a system having two arms (e.g., a second arm 210). The opposite is also true, and the details described for recirculation subsystems 200 describing two arms can equally apply to recirculation subsystems 200 including a single arm, unless otherwise stated herein.

Figure 3A:
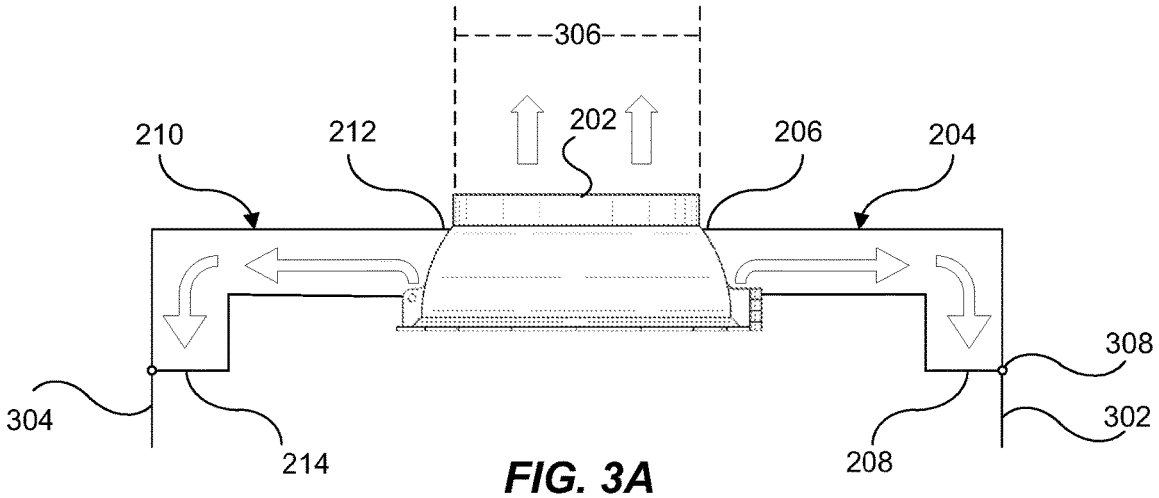
FIGS. 3A-3D are schematics of example recirculation subsystems, according to the present disclosure.

FIGS. 3A-3D are schematics of example recirculation subsystems 200, according to the present disclosure. The schematics provide a detailed view of components of a recirculation subsystem 200. As will be described in greater detail below, the recirculation subsystem 200 can be modular, meaning it can be detachably attachable to the heat pump subsystem 104. Referring to FIG. 3A, the recirculation subsystem 200 can include one or more dampers, for example a first damper 302 and/or a second damper 304. The first damper 302 can open and close to permit or restrict air flow through the first arm 204. When the recirculation subsystem 200 includes a second arm, the second damper 304 can open and close to permit or restrict air flow through the second arm 210. The damper(s) 302, 304 can be positioned at the respective arm outlets (e.g., first arm outlet 208 and/or second arm outlet 214), as shown in FIG. 3A. In other examples, the damper(s) 302, 304 can be positioned at the respective arm inlets (e.g., first arm inlet 206 and/or second arm inlet 212), as will be described in greater detail with respect to FIGS. 4A and 4B.

The first damper 302 and/or the second damper 304 can direct air flow as needed to provide cool air into the air inlets 220, 224. For example, in the case that the temperature where the heat pump water heater 100 is stored is above a predetermined maximum temperature, the first damper 302 and/or the second damper 304 can be opened fully to direct a majority of the air exiting the fan outlet 110 through the respective arms 204, 210. Using FIG. 3A to illustrate, first damper 302 and/or the second damper 304 are completely opened, which enables full flow of cool air through the respective arms 204, 210, and minimal cool air escapes through a duct outlet 306 of the duct adapter 202.

Figure 3B:
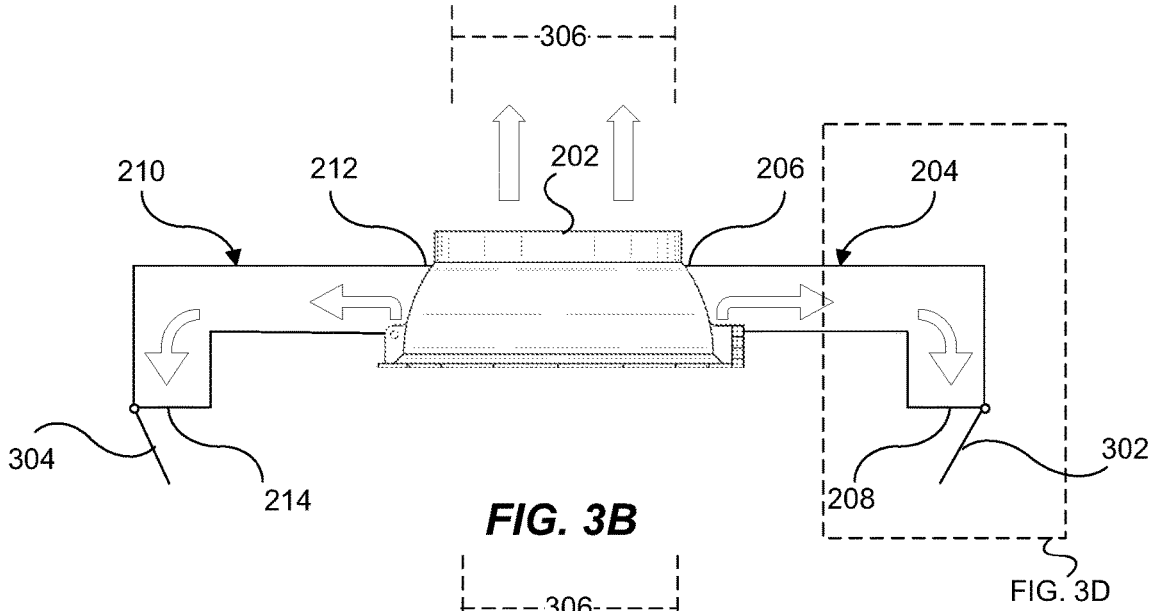
Figure 3C:
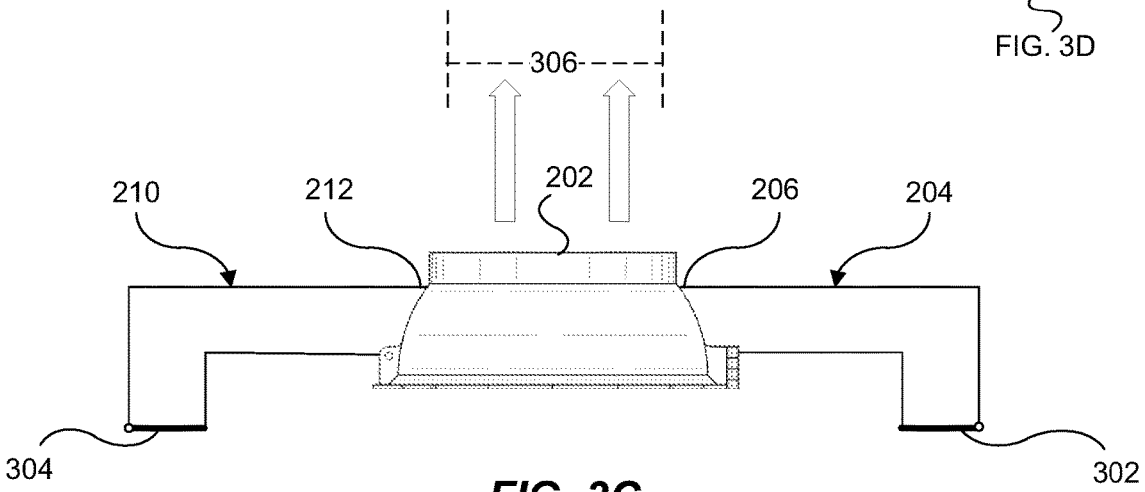

If the temperature where the heat pump water heater 100 is stored is below the predetermined maximum temperature, yet above a predetermined trough temperature, the first damper 302 and/or the second damper 304 can be partially closed so that only a portion of the air flow form the fan outlet 110 is directed into the arms 204, 210. This example is shown in FIG. 3B. Alternatively or in addition, if the temperature where the heat pump water heater 100 is stored is below the predetermined trough temperature, the first damper 302 and/or the second damper 304 can be fully closed, as shown in FIG. 3C. With both the first damper 302 and the second damper 304 fully closed, air removed by the fan 216 can be expelled entirely via the duct outlet 306, as if the recirculation subsystem 200 was not in place. It is contemplated that, although FIGS. 3A-3B show the first damper 302 and the second damper 304 being closed/opened simultaneously and to the same degree, the first damper 302 and the second damper 304 can be opened or closed independently. For example, if the temperature where the heat pump water heater 100 is stored is below the predetermined maximum temperature, yet above a predetermined trough temperature, the first damper 302 or the second damper 304 can be completely open, while the other of the two dampers can be completely closed. Further still, the first damper 302 and the second damper 304 can be placed at any intermediate position independently of the other (i.e., at any position between open and closed). The trough temperature described above can be a predetermined temperature, for example ambient temperature around the heat pump water heater 100, that is deemed sufficiently low so as to enable the heat pump subsystem 104 to properly dissipate heat. Example temperature ranges are described below with reference to FIG. 8.

Unless otherwise stated in this disclosure, when reference is made herein to a single damper (e.g., a first damper 302), it will be understood that the specific example can also refer to a system having two dampers (e.g., a second damper 304). The opposite is also true, and recirculation subsystems 200 describing two dampers can equally apply to recirculation subsystems 200 including a single damper, unless otherwise stated herein. The systems described above with reference to FIGS. 3A-3B can be manually operated, for example by manually moving the one or more dampers 302, 304 from open to closed or vice versa. This opening and closing can be facilitated by hinge 308. In these examples, the dampers 302, 304 can resemble movable doors that can open and close upon the first arm outlet 208 and/or second arm outlet 214. The hinge 308 can include a butt hinge, pivot hinge, piano hinge, spring hinge, or any other type of hinge enabling the dampers 302, 304 to transition between open and closed configuration. In other examples, the dampers 302, 304 can open other than outwardly (e.g., other than hinging like a door). For example, the dampers 302, 304 can open coplanar with respect to the arm outlets 208, 214. In these examples, the dampers 302, 304 can resemble lids slidable along tracks at the end of the arm outlets 208, 214. Alternatively or in addition, the dampers 302, 304 can be rotatably openable, for example via a pivot hinge.

Figure 3D:
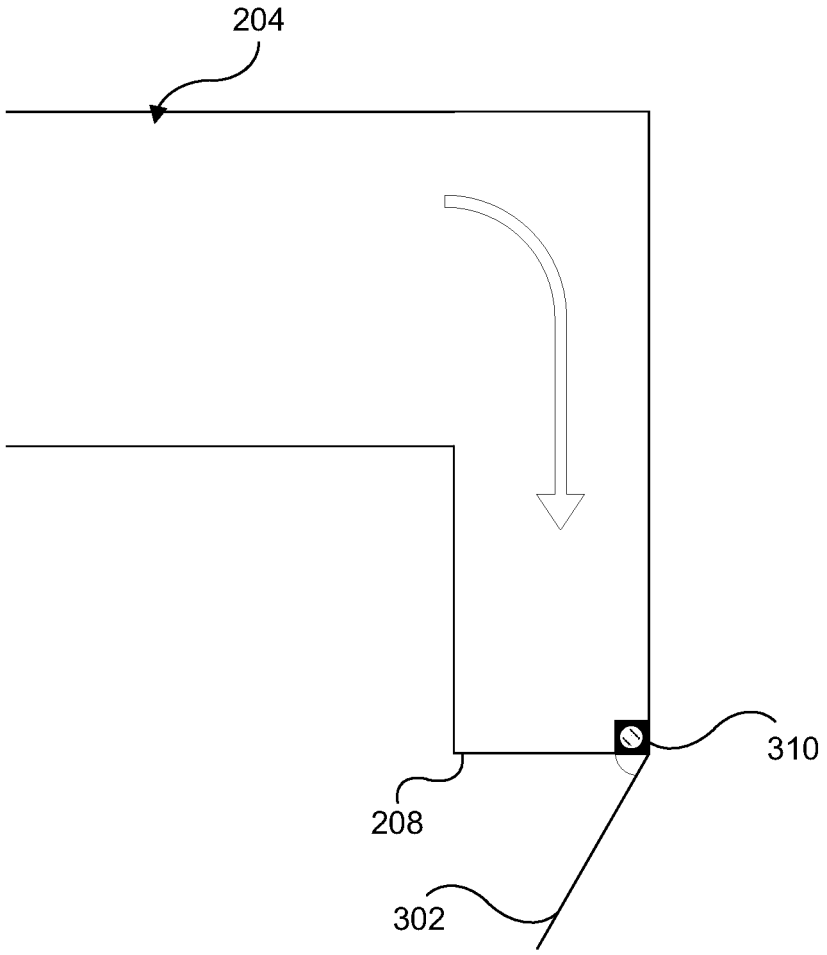

FIG. 3D provides an alternative to manual manipulation of the dampers 302, 304. The recirculation subsystem 200 can include a motor 310 positioned adjacent the dampers 302, 304. The motor 310 can move the first damper between an open configuration (e.g., as shown in FIG. 3A), a closed configuration (e.g., as shown in 3C), or any intermediate position (e.g., as shown in FIG. 3B). The motor 310 can include a servo motor, a rotary actuator, a step motor, a torque motor, worm-drive motor, and/or the like that can transition the dampers 302, 304 between an open configuration and a closed configuration. The motor(s) 310 can be placed at the end of the arms (e.g., first arm 204 and second arm 210) or at other locations proximate the dampers 302, 304. For example, will be described in FIGS. 4A and 4B, the motor(s) 310 can be located near the first arm inlet 206 and/or second arm inlet 212. As will be described in greater detail below, the motor 310 can be controlled by a controller (e.g., controller 106).

Alternatively or in addition to providing a motor 310, the dampers 302, 304 can be mechanically moveable based on the ambient temperature in the room where the heat pump water heater 100 is stored. The hinge 308 can include a bimetallic strip, like in a thermostat, that moves pursuant to thermal expansion. If the temperature is high, the bimetallic strip can extend to open the dampers 302, 304; if the temperature is low, the bimetallic strip can collapse to close the dampers 302, 304.

Figure 4A:
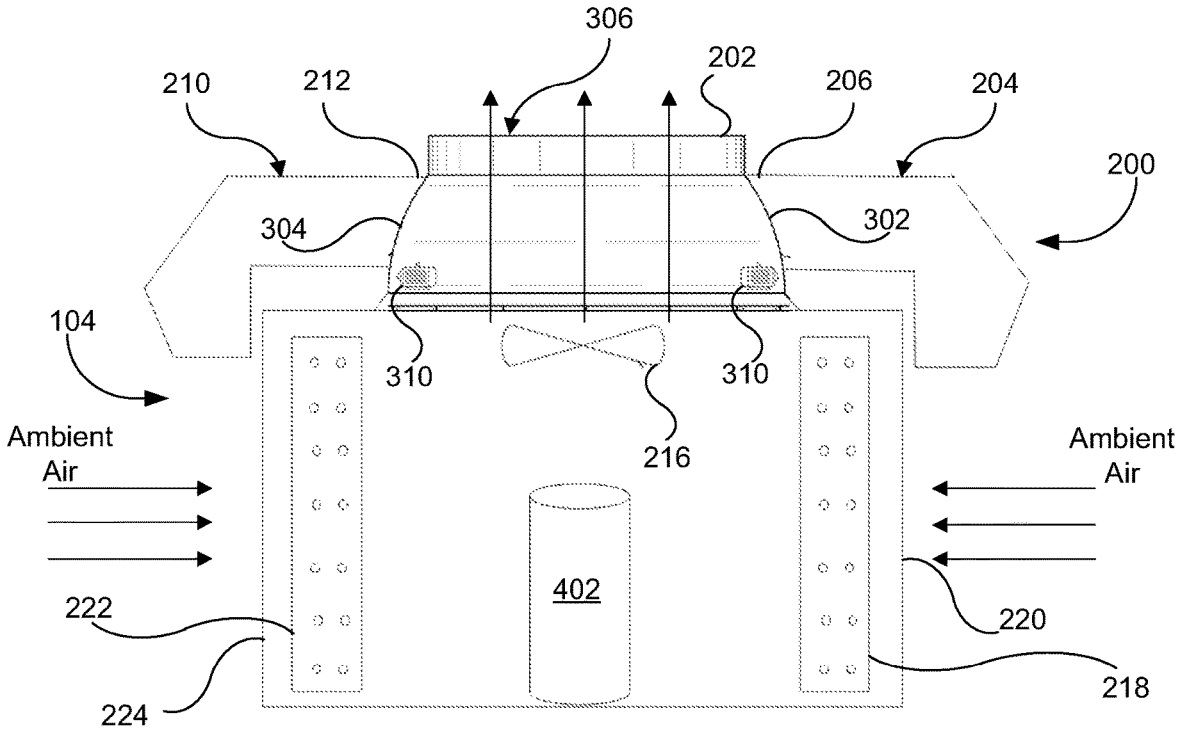
FIGS. 4A and 4B are cross-sectional views of a heat pump water heater having a heat pump subsystem and a recirculation subsystem, according to the present disclosure.
Figure 4B:
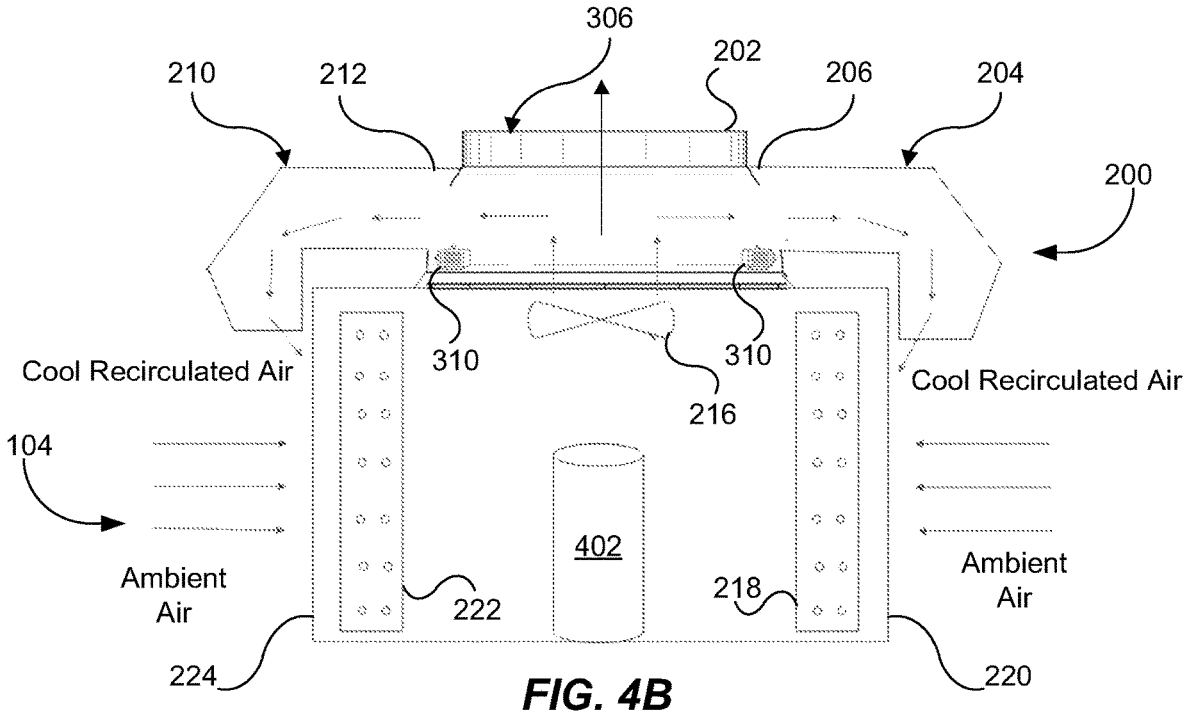

FIGS. 4A and 4B are cross-sectional views of a heat pump water heater 100 having a heat pump subsystem 104 and a recirculation subsystem 200, according to the present disclosure. As described above, the heat pump subsystem 104 can include a compressor 402. The air recirculation attributes of the systems described herein can be used to cool the compressor 402 so that the system draws less current and, therefore, runs more efficiently. The cross-sectional views in FIGS. 4A and 4B also provide a view of where a fan 216 can be located with respect to the duct adapter 202.

FIGS. 4A and 4B illustrate an alternative location for the one or more dampers 302, 304. Instead of being positioned at the arm outlets 208, 214 (e.g., as shown in FIGS. 3A-3C), the dampers 302, 304 can be located at a respective arm inlet (e.g., first arm inlet 206 and/or second arm inlet 212). The dampers 302, 304 can be moved in substantially the same way as described above with respect to FIGS. 3A-3D. For example, the dampers 302, 304 can be moved manually or be moved by one or more motors 310. The motor(s) 310 in these examples can be placed near or within the duct adapter 202, as shown in FIGS. 4A and 4B. In FIG. 4A, the dampers 302, 304 are in a closed configuration, enabling full air flow out of the duct outlet 306 of the duct adapter 202. In FIG. 4B, the dampers 302, 304 are in an open or partially opened configuration, enabling cool air from the fan 216 to enter the one or more arms 204, 210. In FIG. 4B, a portion of the cool air exiting the fan outlet 110 may escape the duct outlet 306. It is contemplated that, in any system described herein, the duct adapter 202 can be closed such that, when the one or more dampers are open, the cool air flows entirely into the arms (e.g., first arm 204 and/or second arm 210). Alternatively or in addition to being placed either at the arm inlets (e.g., first arm inlet 206 or second arm inlet 212) or the arm outlets (e.g., first arm outlet 208 or second arm outlet 214), the one or more dampers 302, 304 can be positioned at other locations along the length of the respective arms 204, 210, for example at some point near the center of the length of the arms 204, 210.

Figure 5A:
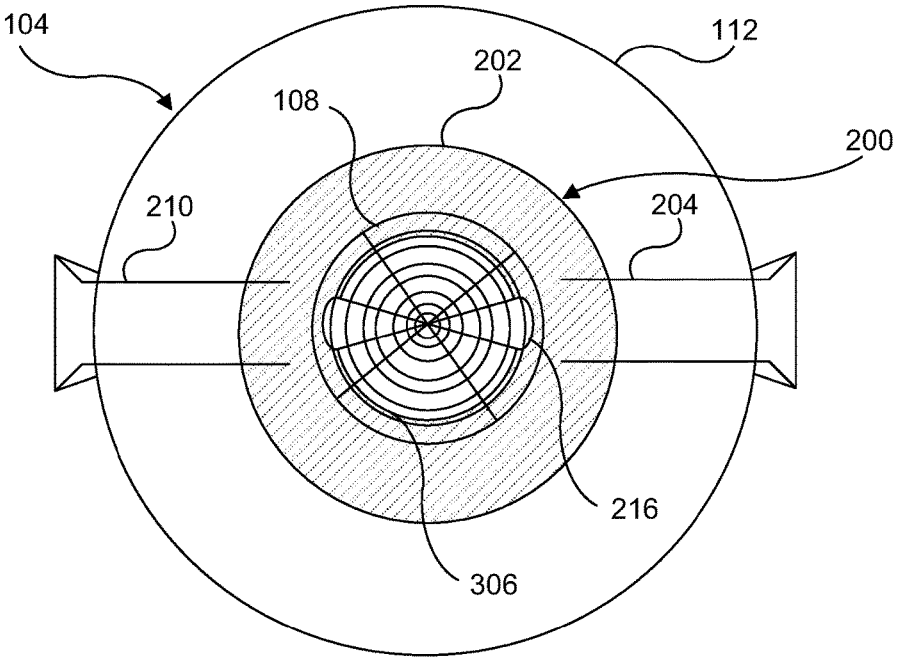
FIGS. 5A-5C are top, partial cross-sectional views of recirculation subsystems positioned on a heat pump subsystem, according to the present disclosure.
Figure 5B:
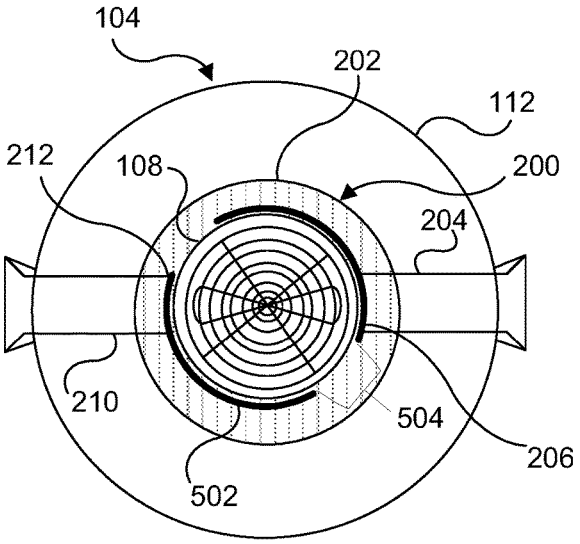
Figure 5C:
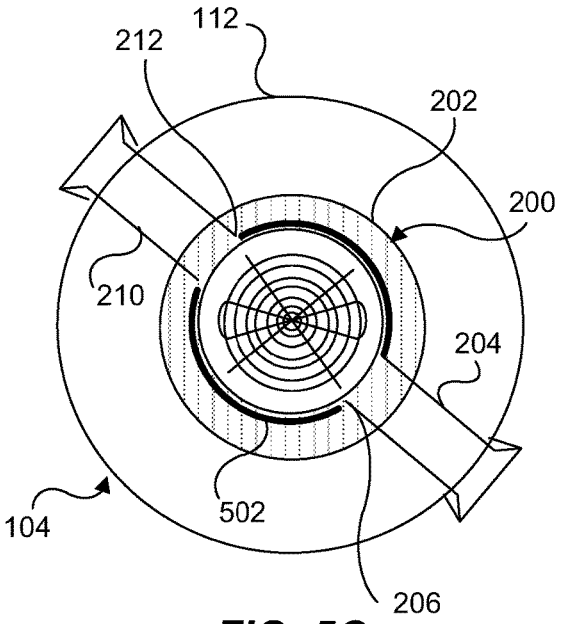

FIGS. 5A-5C are top, partial cross-sectional views of recirculation subsystems 200 positioned on a heat pump subsystem 104, according to the present disclosure. FIG. 5A depicts a top view of a recirculation subsystem 200 placed on top of a heat pump subsystem 104. The duct outlet 306 can be positioned concentrically with respect to the fan outlet 110 (or the vent grate 108 of the heat pump subsystem 104 if present). The first arm 204 and/or second arm 210 can extend radially from the duct adapter 202 positioned proximate the fan outlet 110. The shaded area of the duct adapter 202 can be a solid section that directs cool air to the duct outlet 306, the arms 204, 210, or both.

The various example recirculation subsystems 200 above describe the ability to adjust the air flow into an air inlet 220, 224 by opening or closing dampers 302, 304 positioned along the length of the arms. FIGS. 5B and 5C depict a design wherein the recirculation subsystem 200 can be rotated to either open or closed configurations. The heat pump subsystem 104 (e.g., a heat pump enclosure 112 of the heat pump subsystem 104) can include one or more rotational housings 502 that can be continuous circular flanges except for one or more housing openings 504. The rotational housings 502 (and their respective housing openings 504) can be static. The recirculation subsystem 200 can be independently rotatable with respect to the rotational housings 502 and housing openings 504 such that the first arm inlet 206 and the second arm inlet 212 can move with respect to the rotational housings 502. For example, the recirculation subsystem 200 can be rotated to a closed configuration when the first arm inlet 206 and the second arm inlet 212 are positioned such that they abut or rest adjacent to the rotational housings 502 (see FIG. 5B). The recirculation subsystem 200 can be opened by rotating the system with respect to the rotational housings 502 such that the first arm inlet 206 and the second arm inlet 212 are positioned at the housing openings 504, thereby enabling air to flow into the respective arms 204, 210.

Figure 6:
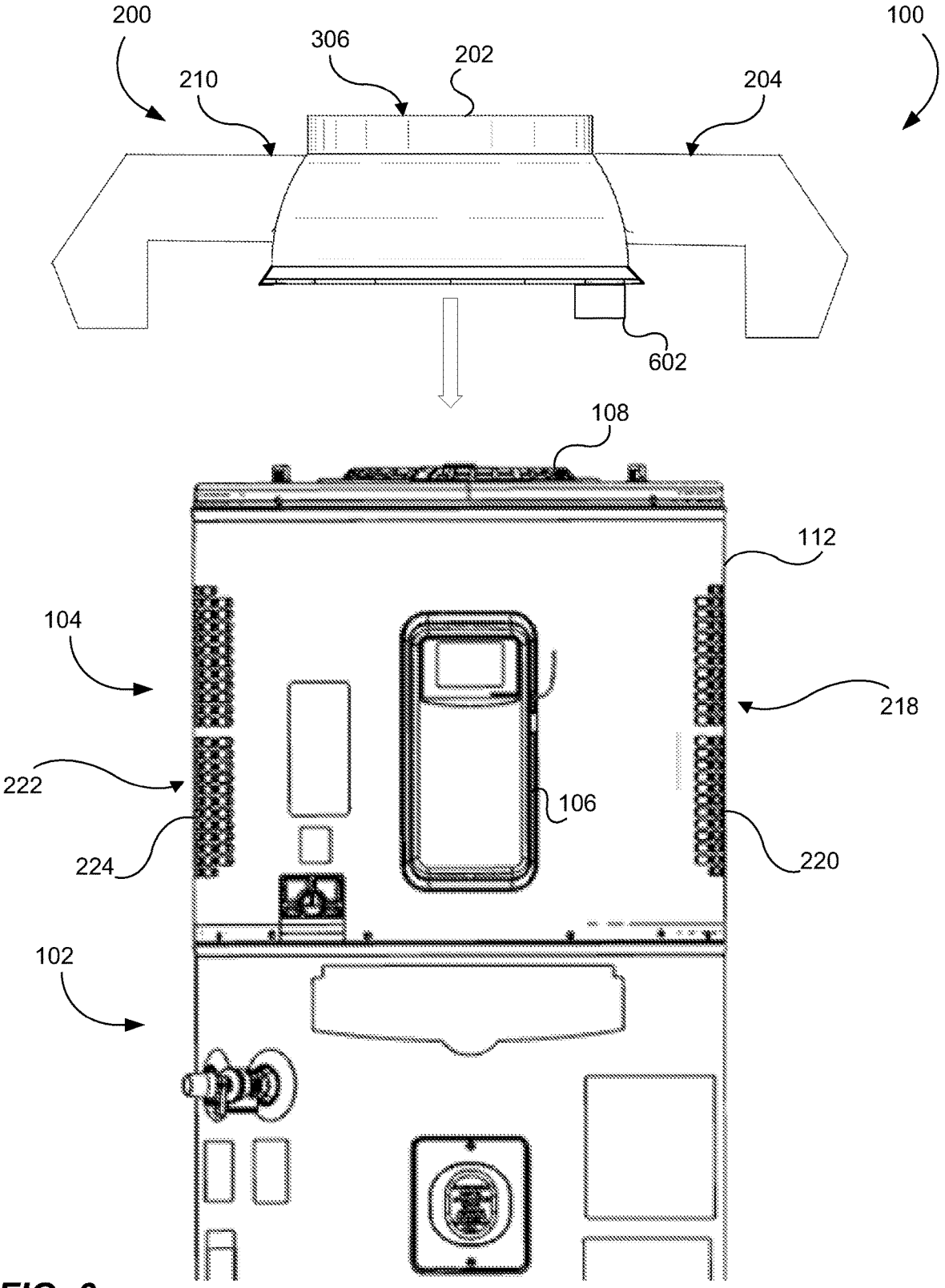
FIG. 6 is a side view of a recirculation subsystem positionable upon a heat pump subsystem, according to the present disclosure.

FIG. 6 is a side view of a recirculation subsystem 200 positionable upon a heat pump subsystem 104, according to the present disclosure. Any of the recirculation subsystem 200 can be permanently attached to the heat pump subsystem 104. Alternatively, the recirculation subsystem 200 can be modular, such that it can be installed when needed and can be removed otherwise. For example, it may be that the storage location of the heat pump water heater 100 remains cool during the winter months. If desired, during these months the recirculation subsystem 200 can be completely removed from the heat pump subsystem 104. It is also contemplated that the recirculation subsystem 200 can be rotated during those months to adjust the air flow (e.g., either manually or with a rotational motor 602, as described below). For example, the recirculation subsystem 200 can be rotatable upon the heat pump subsystem 104 such that the first arm outlet 208 can be moved from a first position distal to the first air inlet 220 to a second position proximate the first air inlet 220 when cool air is in demand. When cool recirculated air is not in demand, for example when ambient temperatures are low, the recirculation subsystem 200 can be rotated again such that the first arm outlet 208 is again positioned distal to the first air inlet 220. This, of course, is also possible for a second arm 210 and a second air inlet 224.

The recirculation subsystem 200 can be sized such that it fits upon and/or engages a heat pump enclosure 112 that houses the internal components of the heat pump subsystem 104. The air inlets (e.g., first air inlet 220 and/or second air inlet 224) can be inlet grilles in the heat pump enclosure 112. For recirculation subsystems 200 that are rotatable on the heat pump subsystem 104, a rotational motor 602 can be placed on the recirculation subsystems 200 between the recirculation subsystem 200 and the heat pump enclosure 112. The rotational motor 602 can include a servo motor, a rotary actuator, a step motor, a torque motor, worm-drive motor, and/or the like that can rotate the recirculation subsystems 200 with respect to the heat pump subsystem 104.

Figure 7A:
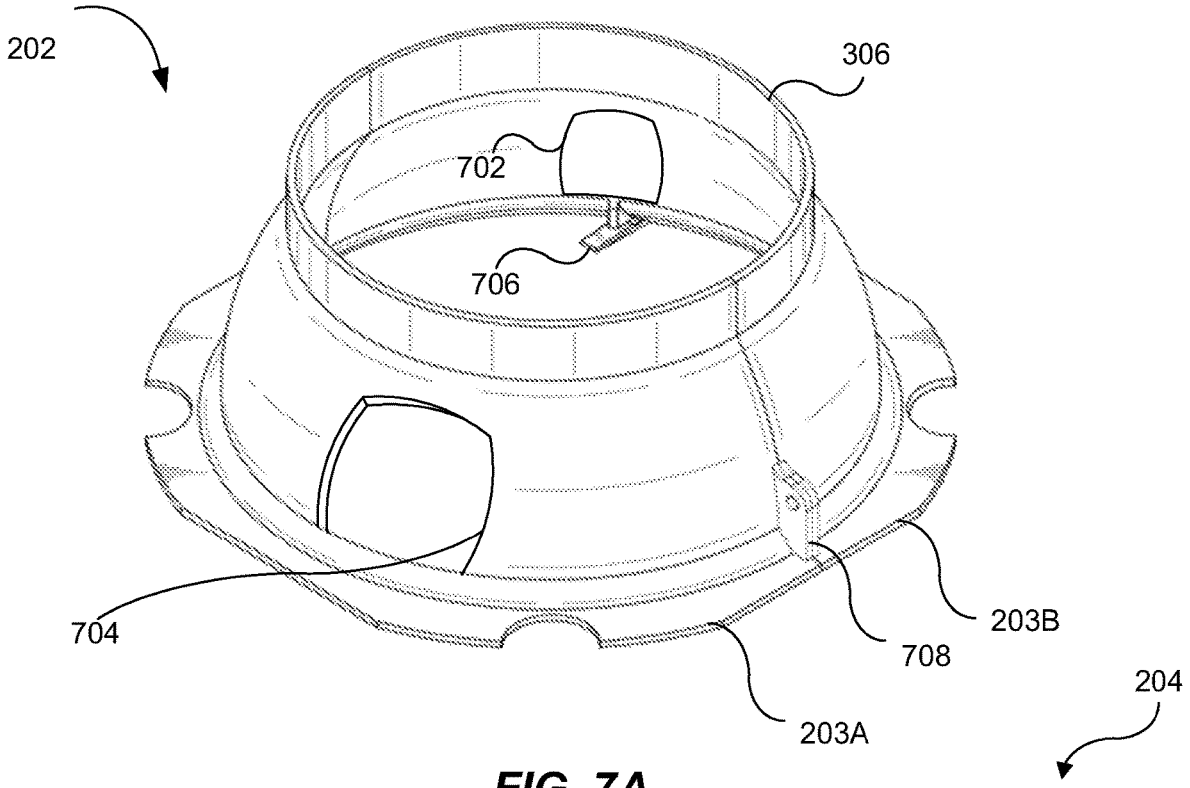
FIGS. 7A and 7B are perspective views of an example duct adapter, according to the present disclosure.
Figure 7B:
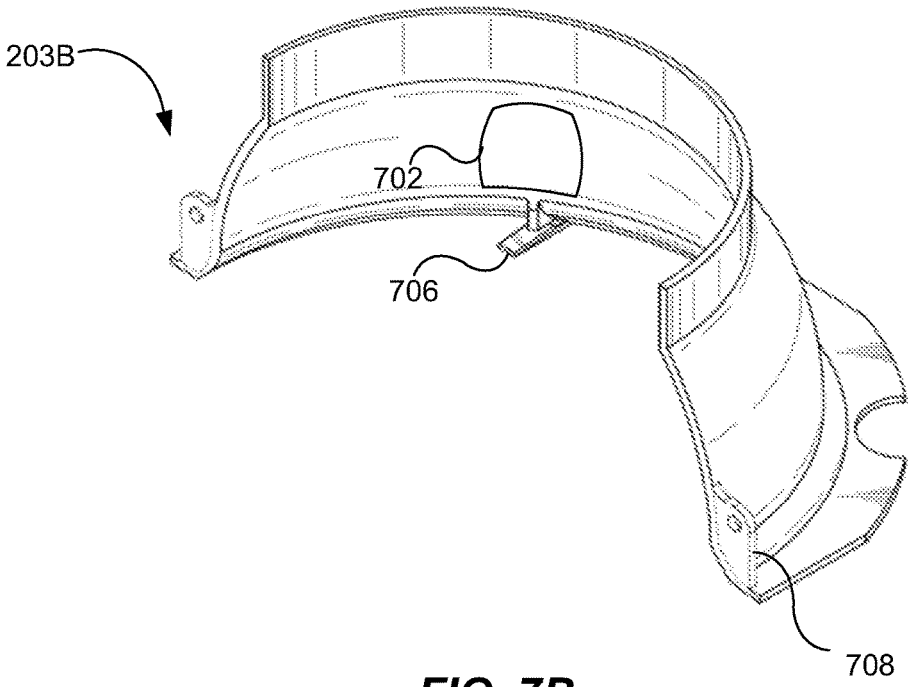

FIGS. 7A and 7B are perspective views of an example duct adapter 202, according to the present disclosure. As described throughout this disclosure, the duct adapter 202 can both be attachable to the heat pump subsystem 104 and can direct the cool air onto the one or more arms 204, 210. Although no particular design is necessary to achieve these goals, the example duct adapter 202 shown in FIGS. 7A and 7B provide an example device to assist in cool air flow out of the heat pump subsystem 104. The duct adapter 202 can include one or more apertures 702, 704 that correspond to the location at which an arm 204, 210 is connected to the duct adapter 202. For example, a first arm inlet 206 can be positioned at a first aperture 702, and a second arm inlet 212 can be positioned at a second aperture 704. In some examples, the recirculation subsystem 200 can include arm covers (not shown) that can be used to cover the apertures 702, 704 when air flow through the arms 204, 210 is not needed (e.g., during winter months or when ambient temperatures are low).

The duct adapter 202 can include one or more attachment members 706 positioned around a lip of the duct adapter 202 to enable attachment of the duct adapter 202 to the heat pump subsystem 104. Referring to FIG. 1 for example, the heat pump subsystem 104 can include a vent grate 108 proximate the fan outlet 110. The attachment member(s) 706 can connect the recirculation subsystem 200 to the vent grate 108. The attachment member(s) 706 can be hooks, tabs, flanges, or protrusions that can engage the vent grate 108.

The duct adapter 202 can be a single-piece construct. Alternatively, and as shown in FIGS. 7A and 7B, the duct adapter 202 can include a plurality of separate sections. For example, the duct adapter 202 can include a first section 203A and a second section 203B, which are attachable to one another. The duct adapter 202 can include a snap 708 enabling the first section 203A the second section 203B to connect. The snap 708 can be a male/female connector, or can include additional fasteners such as a screw or rivet to hold the two sections together. FIG. 7B shows a single side (e.g., second section 203B) of a multi-section duct adapter 202. A multi-section duct adapter 202 can add the additional benefit of enabling the duct adapter 202 to be positioned upon the vent grate 108 such that the one or more attachment members 706 slide under and engage the vent grate 108 as the duct adapter 202 is assembled.

Figure 8:
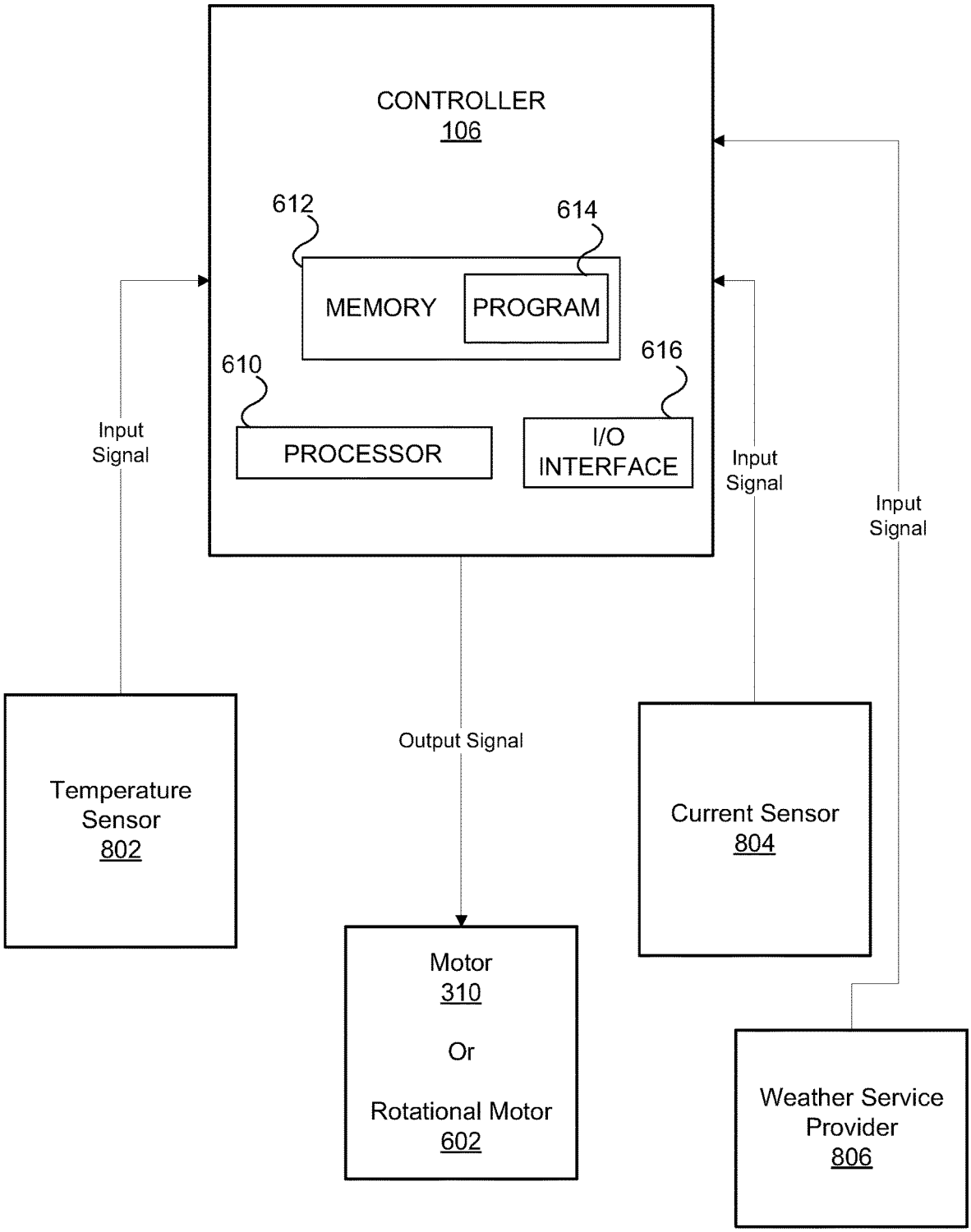
FIG. 8 is a component diagram of a smart air recirculation system that can open or close the recirculation subsystem based on inputs, according to the present disclosure.

FIG. 8 is a component diagram of a smart air recirculation system that can open or close the recirculation subsystem 200 based on inputs, according to the present disclosure. As described above, the systems described herein can include motorized features that enable the recirculation subsystem 200 to transition from open to closed or positions in between. For example, FIG. 3D depicts a recirculation subsystem 200 including a motor 310 that can open and close a damper 302 positioned on a first arm 204 and/or a second arm 210. FIG. 6 depicts a recirculation subsystem 200 including a rotational motor 602 that can open and close the arms 204, 210 by rotating the arms relative to the air inlets 220, 224 or rotational housings 502 (as further described in FIGS. 5B and 5C). The recirculation subsystem 200 can include a controller 106 that can output one or more control signals to the motors described herein to route cool air, when required.

The controller 106 can communicate with the motors (e.g., motor 310 or rotational motor 602) via a wired or wireless connection. To this end, the controller 106 can be positioned directly on the recirculation subsystem 200 or at any other location. For example, the controller 106 can be integrated with the control system of the heat pump water heater 100. FIGS. 1 and 6 provide an example of this embodiment, wherein the controller 106 is integrated with the heat pump enclosure 112. Additional details with respect to the controller 106 are provided in greater detail below.

As described above, certain environments in which the heat pump water heater 100 is stored may not require cool, recirculated air. For example, if the ambient temperature is below 90° F., the heat pump subsystem 104 may dissipate heat sufficiently such that recirculated cool air is not required. However, if the ambient temperature is relatively high, for example above 100° F., cool air recirculated form the fan outlet 110 may help improve efficiency of the heat pump subsystem 104. The air recirculation systems described herein can include a temperature sensor 802 to detect temperatures to assist the controller 106 in making the decisions as to whether the recirculation subsystem 200 is to recirculate cool air to the air inlets 220, 224. The temperature sensor 802 can be a thermometer, thermistor, resistive temperature detector, thermocouple, and the like.

The temperature sensor 802 can be positioned near the heat pump subsystem 104 in the location where the heat pump water heater 100 is stored. For example, the temperature sensor 802 can be placed directly on the heat pump water heater 100 or directly on the apparatus (i.e., on the recirculation subsystem 200); alternatively, the temperature sensor 802 can be placed external to the heat pump water heater 100 within the room, alcove, attic, etc. The temperature sensor 802 can detect the ambient temperature of the room and send a temperature signal to the controller 106 indicative of the ambient temperature. The controller 106 can then output a control signal to the motor(s) to open or close the air flow through the arms 204, 210 based on the temperature.

Illustrating first with an example recirculation subsystem 200 that includes one or more dampers 302, 304 movable by a motor 310, the output signal from the controller 106 can instruct the motor 310 to move the first damper 302 (or the second damper 304) to the open configuration when an ambient temperature proximate the system is above a first predetermined value, to the closed configuration when the ambient temperature is below a second predetermined value, and/or to intermediate locations when the ambient temperature is between the first predetermined value and the second predetermined value. To illustrate, if temperature sensor 802 detects the ambient temperature proximate the system is above 100° F., the controller 106 can send an output signal to the motor(s) 310 to fully open the first damper 302 and/or the second damper 304 to provide full cool air recirculation through the first arm 204 and/or the second arm 210. If temperature sensor 802 detects the ambient temperature proximate the system is between 90° F. and 100° F., for example, the controller 106 can send an output signal to the motor(s) 310 to partially close the first damper 302 and/or the second damper 304 to provide an intermediate degree of cool air recirculation through the first arm 204 and/or the second arm 210. If temperature sensor 802 detects the ambient temperature proximate the system is below 90° F., the controller 106 can send an output signal to the motor(s) 310 to fully close the first damper 302 and the second damper 304 so that air only flows through the duct outlet 306.

A similar process can be used for the rotational motor 602 examples, such as the example systems described with reference to FIGS. 5B, 5C, and 6. If the temperature sensor 802 detects that the ambient temperature near the system is above 100° F., the controller 106 can send an output signal to the rotational motor 602 to rotate the arms 204, 210 such that full cool air recirculation is provided through the first arm 204 and/or the second arm 210 to the air inlets 220, 224; if cool air recirculation is not required or if only an intermediate degree of cool air is required, the output signal to the rotational motor 602 can include instructions to rotate the first arm 204 and the second arm 210 accordingly.

Alternatively or in addition, a temperature sensor 802 can be positioned at the air outlet of the duct adapter 202 (e.g., at the fan outlet 110). In these examples, the temperature sensor 802 can detect the temperature of the cool, dehumidified air exiting the system (i.e., the discharge temperature). This discharge air is typically in the range of 40–50° F. If the air exiting the system is warmer than 40-50° F., it can mean that the system is struggling to dissipate heat and the air flowing through the system is hotter than needed for refrigerant heating. To this end, the temperature sensor 802 can monitor this discharge temperature and, if the air is above a predetermined threshold, the controller 106 can output a signal to the motor(s) (e.g., motor(s) 310 and/or rotational motor 602) in a manner similar to that described above for a temperature sensor that monitors ambient temperature. To use an example, if the temperature of the air leaving the fan outlet 110 is above 70° F., the controller 106 can send an output signal to fully open the arms 204, 210; if the air temperature is between 50° F. and 70° F., the arms 204, 210 can be partially closed; and if the air temperature is below 50° F., the arms 204, 210 can be fully closed to air flow.

Alternatively or in addition to reading the ambient temperature or the discharge temperature, the temperature sensor 802 can also read the suction temperature, evaporating temperature, and/or similar temperatures of the heat pump subsystem 104 and send a signal to the controller 106 regarding those temperatures. The air recirculation systems can include a humidity meter that detects the humidity of the discharge air from the recirculation subsystem 200. As described above, the air that passes across an evaporator is discharged from the heat pump subsystem 104 at a lower humidity than the air that enters the air inlet(s) 220, 224. The apparatus or air recirculation system can include one or more humidity meters that can read the relative humidity of the discharge air to determine if it is above a predetermined threshold. If the humidity is above the predetermined threshold, the controller 106 can output a control signal to open the recirculation subsystem 200 to enable recirculation into the air inlet (s0 220, 224.

The air recirculation systems can include a current sensor 804 to assist the controller 106 in making the decisions as to whether the recirculation subsystem 200 is to recirculate cool air to the air inlets 220, 224. The current sensor 804 can be placed within the electrical circuit that powers the heat pump subsystem 104. As described above, when ambient temperatures are excessively hot, the heat pump subsystem 104 can experience difficulty dissipating heat from operating the compressor 402 and/or fan 216. This can, in turn, cause the electrical components to draw more current. If the current sensor 804 determines that the current drawn by the heat pump subsystem 104 is above a predetermined value, the current sensor 804 can output a signal to the controller 106 to output a control signal to the motors (e.g., motor 310 and/or rotational motor 602) to transition the recirculation subsystem 200 to an open position (i.e., to provide cool, recirculated air to the air inlets 220, 224) as described above for the temperature sensor 802.

The air recirculation systems can include an input/output interface (e.g., input/output interface 616) that facilitates wired or wireless communications with systems external to and separate from the heat pump water heater 100. One of these external systems can include a weather provider service 806. The weather provider service 806 can be, for example, an internet-based service that can provide weather (e.g., temperature) data to the heat pump water heater 100 via the input/output interface 616. The controller 106 can use the weather data to determine whether to open or close the recirculation subsystem 200. For example, the controller 106 can output a control signal to the motors (e.g., motor 310 and/or rotational motor 602) to open the air flow through the arms 204, 210 if the outside temperature is over a predetermined value; the controller 106 can output a control signal to the motors to close the air flow through the arms 204, 210 if the temperature is below a predetermined value. To illustrate using an example, if the outside temperature where the building is location is expected to be 90° F. or higher, the controller 106 can received that weather information from the weather provider service 806 and output a control signal to the motors to open the dampers 302, 304 and/or rotate the recirculation subsystem 200, as described above. If the temperature where the building is location is expected to be below 90° F., the controller 106 can received that weather information from the weather provider service 806 and output a control signal to the motors to close the dampers 302, 304 and/or rotate the recirculation subsystem 200.

Referring again to controller 106, the controller 106 can include a processor 610. The processor 610 can receive signals (e.g., temperature signals, current signals, etc.) and determine whether the recirculation subsystem 200 should be positioned to provide cool air flow through the arms 204, 210. The processor 610 can include one or more of a microprocessor, microcontroller, digital signal processor, co-processor and/or the like or combinations thereof capable of executing stored instructions and operating upon data. The processor 610 can constitute a single core or multiple core processor that executes parallel processes simultaneously. For example, the processor 610 can be a single core processor that is configured with virtual processing technologies. The processor 610 can use logical processors to simultaneously execute and control multiple processes.

The controller 106 can include a memory 612. The memory 612 can be in communication with the one or more processors 610. The memory 612 can include instructions, for example a program 614 or other application, that causes the processor 610 and/or controller 106 to complete any of the processes described herein. For example, the memory 612 can include instructions that cause the controller 106 and/or processor 610 to receive signals (e.g., temperature signals, current signals, etc.) and determine whether to open air flow through the arms 204, 210. The memory 612 can include, in some implementations, one or more suitable types of memory (e.g., volatile or non-volatile memory, random access memory (RAM), read only memory (ROM), programmable read-only memory (PROM), erasable programmable read-only memory (EPROM), electrically erasable programmable read-only memory (EEPROM), magnetic disks, optical disks, floppy disks, hard disks, removable cartridges, flash memory, a redundant array of independent disks (RAID), and the like), for storing files including an operating system, application programs, executable instructions and data.

The controller 106 can communicate with the various components of the heat pump water heater 100 via one or more input/output (I/O) devices 616. The I/O device 616 can include one or more interfaces for receiving signals or input from devices and providing signals or output to one or more devices that allow data to be received and/or transmitted by the controller 106. The I/O device 616 can facilitate wired or wireless connections with any of the components described herein.

Certain examples and implementations of the disclosed technology are described above with reference to block and flow diagrams according to examples of the disclosed technology. It will be understood that one or more blocks of the block diagrams and flow diagrams, and combinations of blocks in the block diagrams and flow diagrams, respectively, can be implemented by computer-executable program instructions. Likewise, some blocks of the block diagrams and flow diagrams do not necessarily need to be performed in the order presented, can be repeated, or do not necessarily need to be performed at all, according to some examples or implementations of the disclosed technology. It is also to be understood that the mention of one or more method steps does not preclude the presence of additional method steps or intervening method steps between those steps expressly identified. Additionally, method steps from one process flow diagram or block diagram can be combined with method steps from another process diagram or block diagram. These combinations and/or modifications are contemplated herein.

It should also be noted that, as used in the specification and the appended claims, the singular forms "a," "an," and "the" include plural references unless the context clearly dictates otherwise. References to a composition containing "a" constituent is intended to include other constituents in addition to the one named.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

While the present disclosure has been described in connection with a plurality of exemplary aspects, as illustrated in the various figures and discussed above, it is understood that other similar aspects can be used, or modifications and additions can be made, to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter. Additionally, the components described herein may apply to any other component within the disclosure. Merely discussing a feature or component in relation to one embodiment does not preclude the feature or component from being used or associated with another embodiment.

What is claimed is:

1. An air recirculation system for a heat pump comprising:
a heat pump subsystem comprising:
a fan;
a fan outlet; and
a first air inlet; and
a recirculation subsystem comprising:
a duct adapter positionable proximate the fan outlet; and
a first arm configured to direct air from the duct adaptor to the first air inlet, the first arm comprising a first portion extending laterally from the duct adapter and a second portion extending in a downward direction from a distal end of the first portion;
wherein the first portion comprises a first arm inlet positioned proximate the duct adaptor, and wherein the second portion comprises a first arm outlet positioned adjacent the first air inlet; and
wherein the recirculation subsystem is configured to direct air expelled from the fan outlet back into the heat pump subsystem for recirculation via the first air inlet.

2. The system of claim 1, wherein the heat pump subsystem comprises a vent grate positioned proximate the fan, and wherein the duct adapter is detachably attachable to the vent grate.

3. The system of claim 2, wherein the duct adapter comprises a plurality of attachment members configured to engage with the vent grate.

4. The system of claim 1, wherein the recirculation subsystem further comprises a first damper configured to transition between an open configuration and a closed configuration,
wherein, when in the open configuration, air can pass through the first arm outlet, and
wherein, when in the closed configuration, air is directed entirely through a duct outlet.

5. The system of claim 4, further comprising:
a motor configured to move the first damper between the open configuration and the closed configuration; and
a controller configured to output a control signal to the motor to move the first damper between the open configuration and the closed configuration.

6. The system of claim 5, further comprising a temperature sensor positioned external to the heat pump subsystem and in communication with the controller, wherein the controller is further configured to output the control signal to the motor to move the first damper to the open configuration when an ambient temperature proximate the system is above a predetermined value.

7. The system of claim 5, further comprising a temperature sensor positioned proximate the duct adapter and in communication with the controller, wherein the controller is further configured to output the control signal to the motor to move the first damper to the open configuration when an air temperature of air from the fan is above a predetermined value.

8. The system of claim 5, further comprising a current sensor configured to detect current into the heat pump subsystem, wherein the controller is further configured to output the control signal to the motor to move the first damper to the open configuration when current into the heat pump subsystem is above a predetermined value.

9. The system of claim 1, wherein the recirculation subsystem is rotatable upon the heat pump subsystem such that the first arm outlet can be moved from a first position distal to the first air inlet to a second position proximate the first air inlet.

10. The system of claim 9, further comprising a rotational motor configured to rotate the recirculation subsystem with respect to the heat pump subsystem.

11. The system of claim 10, further comprising:
a controller configured to output a control signal to the rotational motor to move the first arm outlet from the first position to the second position; and
a temperature sensor positioned external to the heat pump subsystem and in communication with the controller, wherein the controller is further configured to output the control signal to the rotational motor to move the first arm outlet from the first position to the second position when an ambient temperature proximate the system is above a predetermined value.

12. The system of claim 1, wherein:
the heat pump subsystem further comprises a second air inlet; and
the recirculation subsystem further comprises a second arm configured to direct air from the duct adaptor to the second air inlet, the second arm comprising a first portion extending laterally from the duct adapter and a second portion extending in a downward direction from a distal end of the second portion;
wherein the first portion comprises a second arm inlet positioned proximate the duct adapter, and wherein the second portion comprises a second arm outlet positioned adjacent the second air inlet; and
wherein the second arm configured to direct air from the duct adapter to the second air inlet.

13. An air recirculation apparatus comprising:
a duct adapter positionable on top of a heat pump subsystem;
a first arm extending laterally from the duct adapter and comprising (i) a first arm inlet positioned proximate the duct adapter and (ii) a first arm outlet positioned adjacent a first air inlet, the first arm configured to direct air from the duct adapter in a downward direction to the first air inlet of the heat pump subsystem; and
a second arm extending laterally from the duct adapter and comprising (i) a second arm inlet positioned proximate the duct adapter and (ii) a second arm outlet positioned adjacent a second air inlet, the second arm configured to direct air from the duct adapter in a downward direction to the second air inlet of the heat pump subsystem;
wherein the recirculation apparatus is configured to recirculate air expelled from the heat pump system back into the heat pump subsystem via the first air inlet, the second air inlet, or both.

14. The apparatus of claim 13, wherein the duct adapter comprises a plurality of inwardly facing attachment members sized to engage with a vent grate of the heat pump subsystem.

15. The apparatus of claim 13, further comprising:
a first damper disposed along the first arm and configured to transition between an open configuration and a closed configuration; and
a second damper disposed along the second arm configured to transition between an open configuration and a closed configuration,
wherein, when the first damper and the second damper are in the open configurations, air can pass through the first arm outlet and the second arm outlet, and
wherein, when the first damper and the second damper are in the closed configurations, air is directed entirely through a duct outlet of the duct adapter.

16. The apparatus of claim 15, further comprising:

a first motor configured to move the first damper between the open configuration and the closed configuration;

a second motor configured to move the second damper between the open configuration and the closed configuration; and a controller configured to output a first control signal to the first motor to move the first damper between the open configuration and the closed configuration and output a second control signal to the second motor to move the second damper between the open configuration and the closed configuration.

17. The apparatus of claim 16, further comprising a temperature sensor positioned proximate the duct adapter and in communication with the controller, wherein the controller is further configured to output the first control signal to the first motor and the second control signal to the second motor to move the respective motors to the open configuration when air flowing through the duct adapter is above a predetermined value.

18. The apparatus of claim 16, further comprising a temperature sensor in communication with the controller, wherein the controller is further configured to output the first control signal to the first motor and the second control signal to the second motor to move the respective motors to the open configuration when an ambient temperature proximate the apparatus is above a predetermined value.

19. The apparatus of claim 16, further comprising a current sensor configured to detect current into the heat pump subsystem, wherein the controller is further configured to output the first control signal to the first motor and the second control signal to the second motor to move the respective motors to the open configuration when current into the heat pump subsystem is above a predetermined value.

20. The apparatus of claim 16, wherein the controller comprises an input/output interface configured to receive a wired or wireless communication from a weather service provider comprising data indicative of outside temperature, wherein the controller is further configured to output the first control signal to the first motor and the second control signal to the second motor to move the respective motors to the open configuration when the data indicates the outside temperature is above a predetermined value.

* * * * *